US011285510B2

(12) United States Patent
Kagayama

(10) Patent No.: US 11,285,510 B2
(45) Date of Patent: Mar. 29, 2022

(54) VIBRATOR DEVICE

(71) Applicant: Murata Manufacturing Co., Ltd., Nagaokakyo (JP)

(72) Inventor: Kenji Kagayama, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 271 days.

(21) Appl. No.: 16/805,967

(22) Filed: Mar. 2, 2020

(65) Prior Publication Data

US 2020/0197979 A1 Jun. 25, 2020

Related U.S. Application Data

(63) Continuation of application No. PCT/JP2018/032081, filed on Aug. 30, 2018.

(30) Foreign Application Priority Data

Sep. 4, 2017 (JP) ..... JP2017-169174
Feb. 6, 2018 (JP) ..... JP2018-018894

(51) Int. Cl.
*B06B 1/06* (2006.01)
*G08B 6/00* (2006.01)

(52) U.S. Cl.
CPC ..... *B06B 1/0603* (2013.01); *G08B 6/00* (2013.01)

(58) Field of Classification Search
CPC ..... H01L 41/1134; H01L 41/09; H02N 2/186; B06B 1/0603; B06B 1/0644; B06B 1/06; G08B 6/00
See application file for complete search history.

(56) References Cited

U.S. PATENT DOCUMENTS 8,093,784 B2 1/2012 Harigai et al.
9,827,594 B2 * 11/2017 Moon ..... H01L 41/04
(Continued)

FOREIGN PATENT DOCUMENTS

CN 105975088 A 9/2016
JP H1169488 A 3/1999
(Continued)

OTHER PUBLICATIONS

International Search Report Issued for PCT/JP2018/032081, dated Dec. 4, 2018.
(Continued)

*Primary Examiner* — Quan Zhen Wang
*Assistant Examiner* — Rajsheed O Black-Childress
(74) *Attorney, Agent, or Firm* — Arent Fox LLP

(57) ABSTRACT

A vibrator device that includes a support member, first and second displacement plates, first and second piezoelectric vibrator elements, and an added mass member. The support member has first and second side portions opposing each other. The first displacement plate is supported by the first side portion and extends toward the second side portion so as to have a free end. The second displacement plate is supported by the second side portion and extends toward the first side portion so as to have a free end. The first and second piezoelectric vibrator elements are respectively disposed on the first and second displacement plates. The added mass member is connected to a portion of the first displacement plate at or around the free end thereof and to a portion of the second displacement plate at or around the free end thereof.

20 Claims, 12 Drawing Sheets

(56) References Cited

U.S. PATENT DOCUMENTS

| | | | | |
|---|---|---|---|---|
| 10,639,676 | B2 | 5/2020 | Kagayama et al. | |
| 2011/0278991 | A1 | 11/2011 | Harigai et al. | |
| 2017/0028441 | A1* | 2/2017 | Kagayama | H01L 41/09 |
| 2019/0240697 | A1* | 8/2019 | Kagayama | B06B 1/0644 |
| 2021/0331206 | A1* | 10/2021 | Kishishita | B06B 1/0644 |

FOREIGN PATENT DOCUMENTS

| | | | |
|---|---|---|---|
| JP | 200023315 | A | 8/2000 |
| JP | 2001193786 | A | 7/2001 |
| JP | 2010029579 | A | 2/2010 |
| JP | 2010216841 | A | 9/2010 |
| JP | 2010216842 | A | 9/2010 |
| JP | 4767369 | B1 | 9/2011 |
| WO | 2015163166 | A1 | 10/2015 |

OTHER PUBLICATIONS

Written Opinion of the International Searching Authority issued for PCT/JP2018/032081, dated Dec. 4, 2018.

* cited by examiner

VIBRATOR DEVICE

CROSS REFERENCE TO RELATED APPLICATIONS

The present application is a continuation of International application No. PCT/JP2018/032081, filed Aug. 30, 2018, which claims priority to Japanese Patent Application No. 2017-169174, filed Sep. 4, 2017, and Japanese Patent Application No. 2018-018894, filed Feb. 6, 2018, the entire contents of each of which are incorporated herein by reference.

FIELD OF THE INVENTION

The present invention relates to a vibrator device.

BACKGROUND OF THE INVENTION

Hitherto, various vibrator devices have been proposed as a vibrator device for a purpose such as informing a user of an incoming call. The following Patent Document 1 discloses an example of such a vibrator device. In the vibrator device disclosed in Patent Document 1, an elastic plate which is formed by bending a metal plate to have a U-like shape as viewed from the lateral side of the vibrator device is used. One side of the bending portion of this elastic plate is used as a planar fixed portion, while the other side is used as a planar vibrating portion.

Patent Document 1: International Publication No. 2015/163166

SUMMARY OF THE INVENTION

Lately, reducing the size of vibrator devices is being demanded. The vibrator device disclosed in Patent Document 1 includes many regions where almost no vibration is produced. If such a vibrator device is reduced in size, it fails to produce a large driving force.

It is an object of the present invention to provide a vibrator device that is small in size and yet produces a large driving force.

A vibrator device according to the present invention includes a support member, first and second displacement plates, first and second piezoelectric vibrator elements, and an added mass member. The support member has first and second side portions which oppose each other. The first displacement plate is supported by the first side portion of the support member and extends toward the second side portion so as to have a free end. The second displacement plate is supported by the second side portion of the support member and extends toward the first side portion so as to have a free end. The first and second piezoelectric vibrator elements are respectively disposed on the first and second displacement plates. The added mass member is connected to a portion of the first displacement plate at or around the free end thereof and also to a portion of the second displacement plate at or around the free end thereof.

The vibrator device according to the present invention is small in size and is yet able to produce a large driving force.

DETAILED DESCRIPTION OF THE PREFERRED EMBODIMENTS

The present invention will be described below with reference to the drawings through illustration of specific embodiments.

The embodiments disclosed in the specification are only examples. The configurations described in the different embodiments may partially be replaced by or combined with each other.

Figure 1:
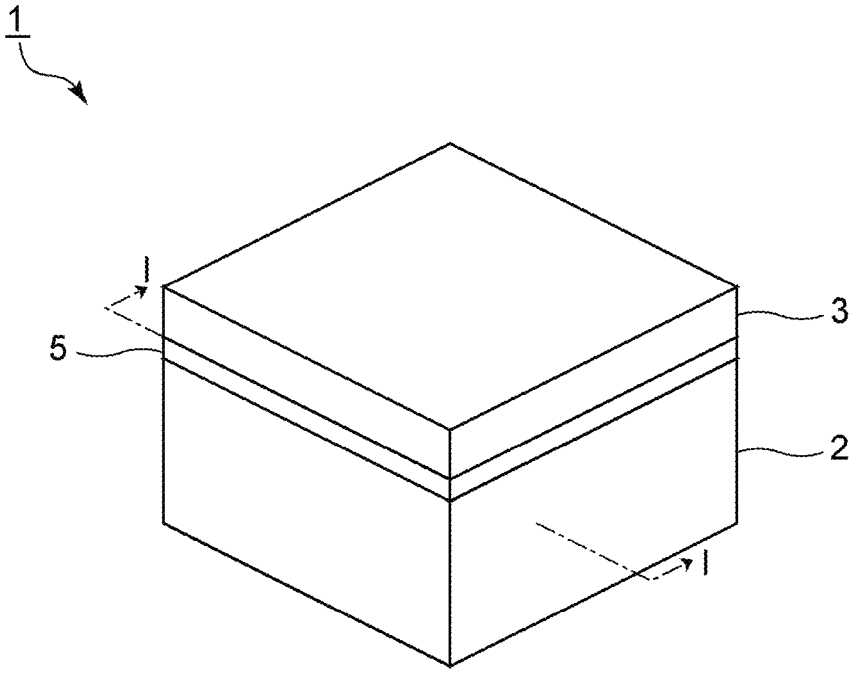
FIG. 1 is a perspective view of a vibrator device according to a first embodiment of the present invention.
Figure 2:
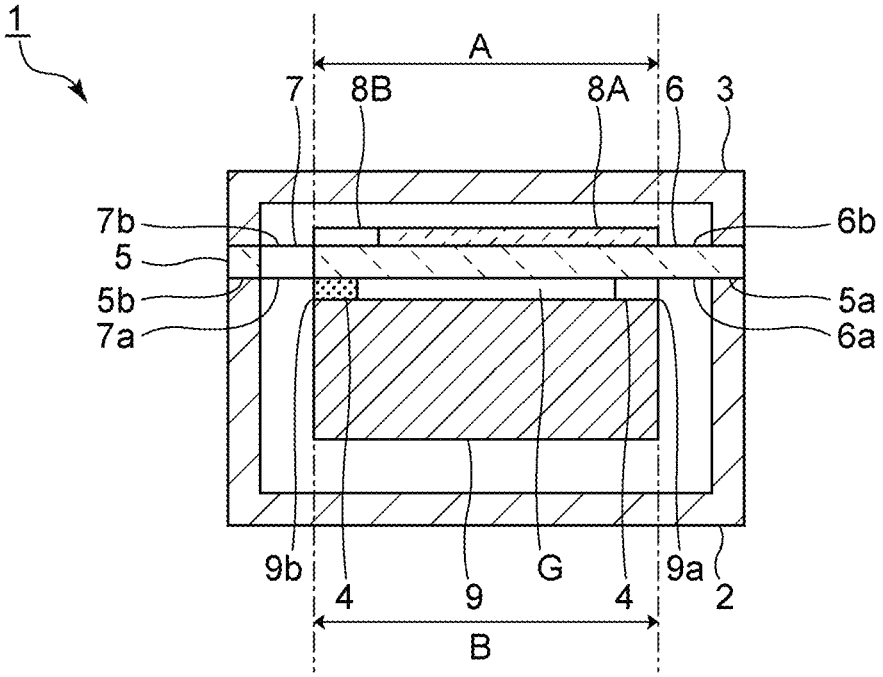
FIG. 2 is a sectional view taken along line I-I in FIG. 1.
Figure 3:
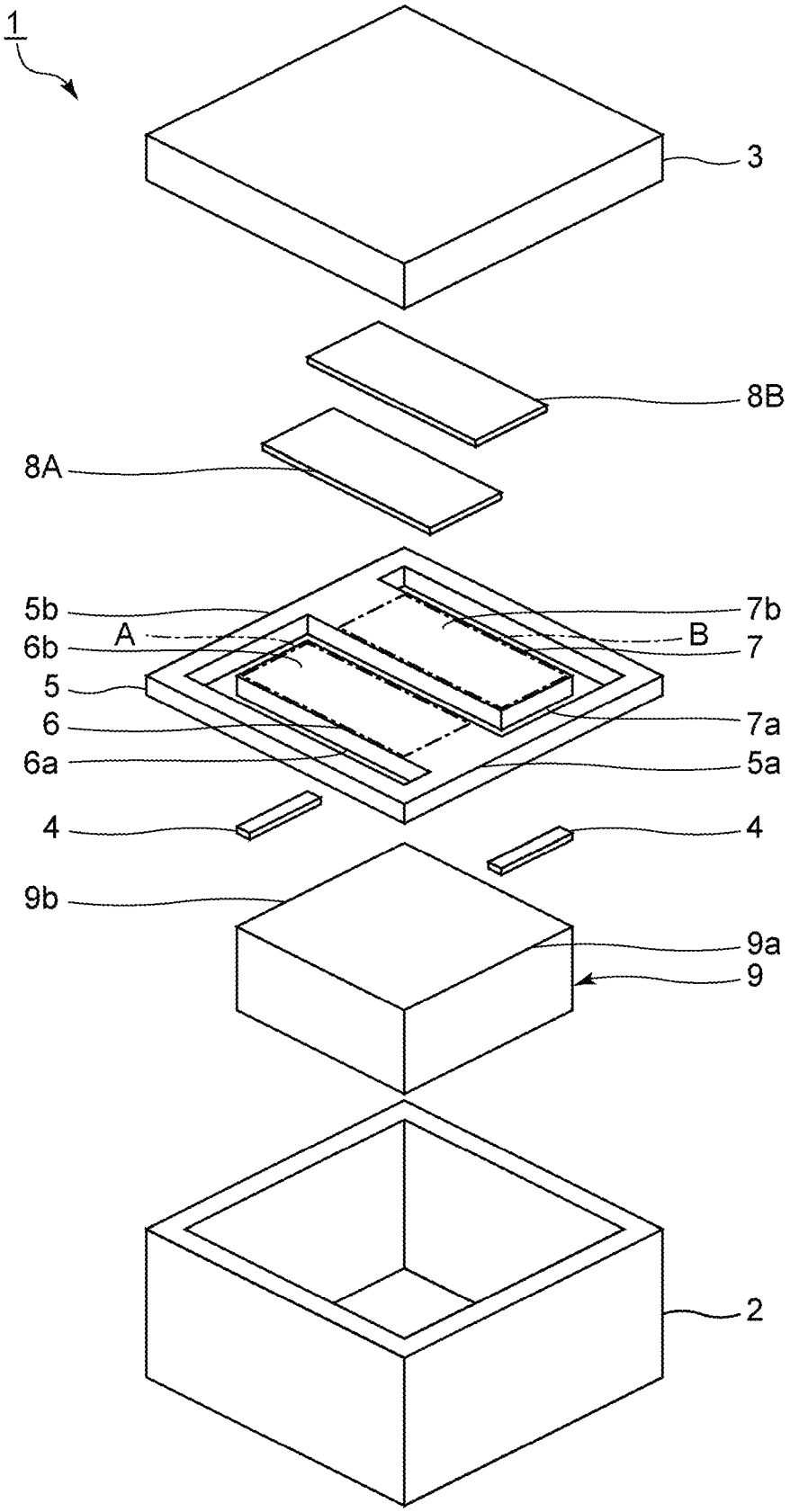
FIG. 3 is an exploded perspective view of the vibrator device according to the first embodiment of the present invention.

FIG. 1 is a perspective view of a vibrator device according to a first embodiment of the present invention. FIG. 2 is a sectional view taken along line I-I in FIG. 1. FIG. 3 is an exploded perspective view of the vibrator device according to the first embodiment.

As shown in FIG. 1, a vibrator device 1 includes first and second casing members 2 and 3. A support member 5 is disposed between the first and second casing members 2 and 3. The first and second casing members 2 and 3 and the support member 5 form a case. The case is formed in the shape of a rectangular parallelepiped. The shape of this case as viewed from above, that is, as viewed in the stacking direction of the first casing member 2, the support member 5, and the second casing member 3, is a square. The shape of the case as viewed from above is not restricted to a square and may be a rectangle, for example.

The bottom portion of the first casing member 2 is bonded to a mounting substrate so that the vibrator device 1 is mounted on the mounting substrate. Vibration is transmitted from the vibrator device 1 to outside via the bottom portion of the first casing member 2.

The first and second casing members 2 and 3 are made of a metal or a synthetic resin. Examples of the synthetic resin are LCP, PEEK, and PPS. Examples of the metal are stainless steel and a copper alloy.

As shown in FIGS. 2 and 3, the support member 5 is formed in a frame-like shape and is constituted by plural side portions. The plural side portions of the support member 5 include first and second side portions 5*a* and 5*b* parallel with each other. A first displacement plate 6 extends from the first side portion 5*a* toward the second side portion 5*b*. The first displacement plate 6 is supported by the first side portion 5*a* in a cantilever structure so as to have a first free end. A second displacement plate 7 extends from the second side portion 5*b* toward the first side portion 5*a*. The second displacement plate 7 is supported by the second side portion 5*b* in a cantilever structure so as to have a second free end. As viewed from above (i.e., the stacking direction of the first casing member 2, the support member 5, and the second casing member 3), the first and second displacement plates 6 and 7 are disposed point-symmetrically to each other with respect to the center of the inner peripheral shape of the frame-like support member 5. The first and second displacement plates 6 and 7 overlap each other, as viewed from a direction parallel with the extending direction of the first side portion 5*a*.

In this embodiment, the support member 5 and the first and second displacement plates 6 and 7 are integrally formed. Alternatively, first and second displacement plates 6 and 7, which are separated elements from the support member 5, may be connected to the support member 5. As in this embodiment, however, as a result of integrally forming the support member 5 and the first and second displacement plates 6 and 7, vibration can be transmitted, not through different materials, but through the same material, thereby enhancing the efficiency in transmitting vibration. Additionally, the support member 5 and the first and second displacement plates 6 and 7 are free from joint portions of different materials. This makes it less likely to cause breakage, such as a fatigue fracture, due to a cyclic bending stress applied to the portion of the first displacement plate 6 supported by the support member 5 and the portion of the second displacement plate 7 supported by the support member 5.

Typically, in a vibrator device which induces a plate to bend, for example, a free end and a fixed end are required. In this embodiment, the end portions of the displacement plates connected to the casing members are used as the fixed ends, and the support member and the displacement plates are integrally formed. In this configuration, it is not necessary to dispose a different material, such as a member for connecting the support member and the displacement plates. It is therefore unnecessary to provide a structural space for connecting the support member and the displacement plates between the support member and the displacement plates and between the support member and the casing members. That is, the vibrator device 1 can be reduced in size.

The first displacement plate 6 has first and second main surfaces 6*a* and 6*b* opposing each other. The first main surface 6*a* is located proximal to the first casing member 2, while the second main surface 6*b* is located proximal to the second casing member 3. On the second main surface 6*b*, a first piezoelectric vibrator element 8A is disposed. The first displacement plate 6 and the first piezoelectric vibrator element 8A form a unimorph vibrator.

Likewise, the second displacement plate 7 has first and second main surfaces 7*a* and 7*b*. The first main surface 7*a* is located proximal to the first casing member 2, while the second main surface 7*b* is located proximal to the second casing member 3. On the second main surface 7*b*, a second piezoelectric vibrator element 8B is disposed. The second displacement plate 7 and the second piezoelectric vibrator element 8B form a unimorph vibrator. The first and second piezoelectric vibrator elements 8A and 8B are not limited to a specific shape. In this embodiment, the first and second piezoelectric vibrator elements 8A and 8B have a planar rectangular shape.

Figure 4:
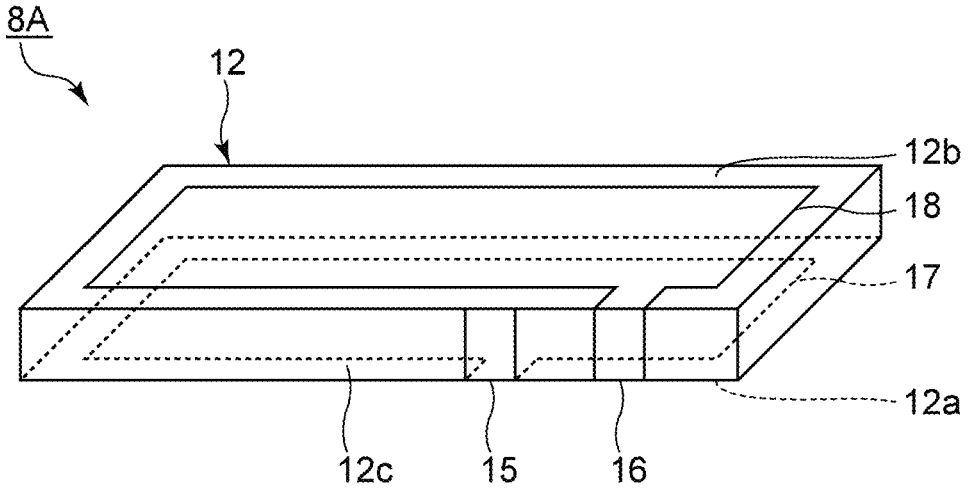
FIG. 4 is a perspective view of a piezoelectric vibrator element in the first embodiment of the present invention.
Figure 5:
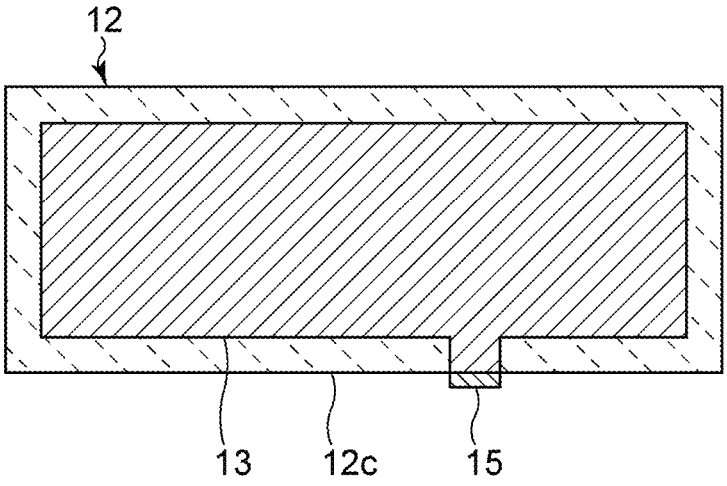
FIG. 5 is a planar sectional view of the piezoelectric vibrator element in the first embodiment of the present invention.
Figure 6:
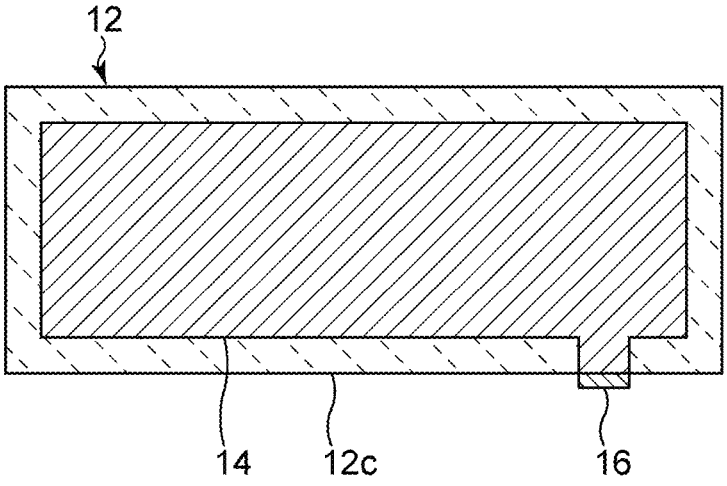
FIG. 6 is a planar sectional view of a portion of the piezoelectric vibrator element in the first embodiment of the present invention, which is different from that shown in FIG. 5.

FIG. 4 is a perspective view of the first piezoelectric vibrator element 8A in the first embodiment. FIG. 5 is a planar sectional view of the first piezoelectric vibrator element 8A in the first embodiment. FIG. 6 is a planar sectional view of a portion of the first piezoelectric vibrator element 8A in the first embodiment, which is different from that shown in FIG. 5.

As shown in FIG. 4, the first piezoelectric vibrator element 8A includes a piezoelectric multilayer body 12 constituted by multiple piezoelectric layers stacked on each other. The piezoelectric multilayer body 12 has first and second main surfaces 12*a* and 12*b* opposing each other. The first main surface 12*a* is located proximal to the above-described first displacement plate. The piezoelectric multilayer body 12 has a side surface 12*c* connecting the first and second main surfaces 12*a* and 12*b*. The material for the piezoelectric multilayer body 12 is not restricted to a particular material. In this embodiment, the piezoelectric multilayer body 12 is made of PZT ceramics.

On the first main surface 12*a* of the piezoelectric multilayer body 12, a first outer electrode 17 is disposed. On the second main surface 12*b*, a second outer electrode 18 is disposed. The first and second outer electrodes 17 and 18 are connected to different potentials.

Within the piezoelectric multilayer body 12, multiple inner electrodes are stacked on each other with the piezoelectric layers interposed therebetween. More specifically, in this embodiment, a first inner electrode 13 shown in FIG. 5 and a second inner electrode 14 shown in FIG. 6 are alternatively stacked on each other. The first piezoelectric vibrator element 8A includes multiple first inner electrodes 13 and multiple second inner electrodes 14. The first inner electrodes 13 and the second inner electrodes 14 extend to the side surface 12*c* of the piezoelectric multilayer body 12 such that the extending portions of the first inner electrodes 13 and those of the second inner electrodes 14 do not overlap each other as viewed from above.

As shown in FIG. 4, on the side surface 12*c* of the piezoelectric multilayer body 12, first and second connecting electrodes 15 and 16 are disposed such that they do not contact each other. The multiple first inner electrodes are connected to the first connecting electrode 15. The multiple first inner electrodes are electrically connected to the first outer electrode 17 via the first connecting electrode 15. The multiple second inner electrodes are connected to the second connecting electrode 16. The multiple second inner electrodes are electrically connected to the second outer electrode 18 via the second connecting electrode 16. The first main surface 12*a* of the piezoelectric multilayer body 12 is bonded to the first displacement plate by an adhesive.

The configuration of the first piezoelectric vibrator element 8A shown in FIG. 4 is only an example and is not limited to that described above. For example, although the piezoelectric body of the first piezoelectric vibrator element 8A is the piezoelectric multilayer body 12 in this embodiment, it may be constituted by a single layer. However, the piezoelectric body of the first piezoelectric vibrator element 8A is preferably the piezoelectric multilayer body 12. This makes it possible to drive the vibrator device 1 with the application of an even low voltage. The second piezoelectric vibrator element 8B shown in FIG. 3 is configured similarly to the first piezoelectric vibrator element 8A and is bonded to the second displacement plate 7 by an adhesive.

Referring back to FIGS. 2 and 3, as a result of applying an alternating-current electric field to the first piezoelectric vibrator element 8A, the first piezoelectric vibrator element 8A expands and contracts in the in-planar direction. This induces the first displacement plate 6 to vibrate in a bending mode. Likewise, in accordance with the vibration of the second piezoelectric vibrator element 8B in the in-planar direction, the second displacement plate 7 vibrates in a bending mode. In this embodiment, the vibration of the first displacement plate 6 and that of the second displacement plate 7 are the same. In this specification, the meaning of "the vibration of the first displacement plate 6 and that of the second displacement plate 7 are the same" includes that the vibration of the first displacement plate 6 and that of the second displacement plate 7 are substantially the same to such a degree not to significantly decrease the characteristics of the vibrator device.

The support member 5 and the first and second displacement plates 6 and 7 are made of a metal or a synthetic resin. The support member 5 and the first and second displacement plates 6 and 7 are preferably made of stainless steel having high stiffness and high rust-protection properties. This makes it less likely to decrease the vibration strength in the first and second displacement plates 6 and 7.

An added mass member 9 is connected to the first main surface 6*a* of the first displacement plate 6 and the first main surface 7*a* of the second displacement plate 7. More specifically, the respective first and second free ends of the first and second displacement plates 6 and 7 are connected to the added mass member 9. The added mass member 9 may not necessarily be connected to the end of the free ends of the first and second displacement plates 6 and 7, and may be connected to portions of the first and second displacement plates 6 and 7 near the end of these free ends. It is however desirable that the added mass member 9 be connected to the free ends of the first and second displacement plates 6 and 7.

The added mass member 9 is not restricted to a particular shape, and it is a rectangular parallelepiped in this embodiment. The added mass member 9 is made of a metal, a synthetic material of a metal and a resin, or ceramics. The added mass member 9 is desirably made of a metal having a high density, such as tungsten exhibiting a high added-mass effect. This can easily reduce the size of the vibrator device 1.

The first displacement plate 6 includes a first region A which overlaps the added mass member 9 as viewed from above (i.e., in the stacking direction). The first region A includes a portion of the first displacement plate 6 positioned proximal to the first side 5*a* relative to the portion connected to the added mass member 9. Likewise, the second displacement plate 7 includes a second region B which overlaps the added mass member 9 as viewed from above (i.e., in the stacking direction). The second region B includes a portion of the second displacement plate 7 positioned proximal to the second side 5*b* relative to the portion connected to the added mass member 9. The center of the support member 5 and the center of gravity of the added mass member 9 coincide with each other, as viewed from above.

In this embodiment, multiple connecting members 4 are provided on the added mass member 9. The added mass member 9 is connected to the first and second displacement plates 6 and 7 via the connecting members 4.

In this embodiment, the added mass member 9 is connected to both the first and second displacement plates 6 and 7, and the first displacement plate 6 includes the first region A, while the second displacement plate 7 includes the second region B. The reason why the vibrator device 1 can effectively be reduced in size will be explained below by comparison of this embodiment with a comparative example.

Figure 7:
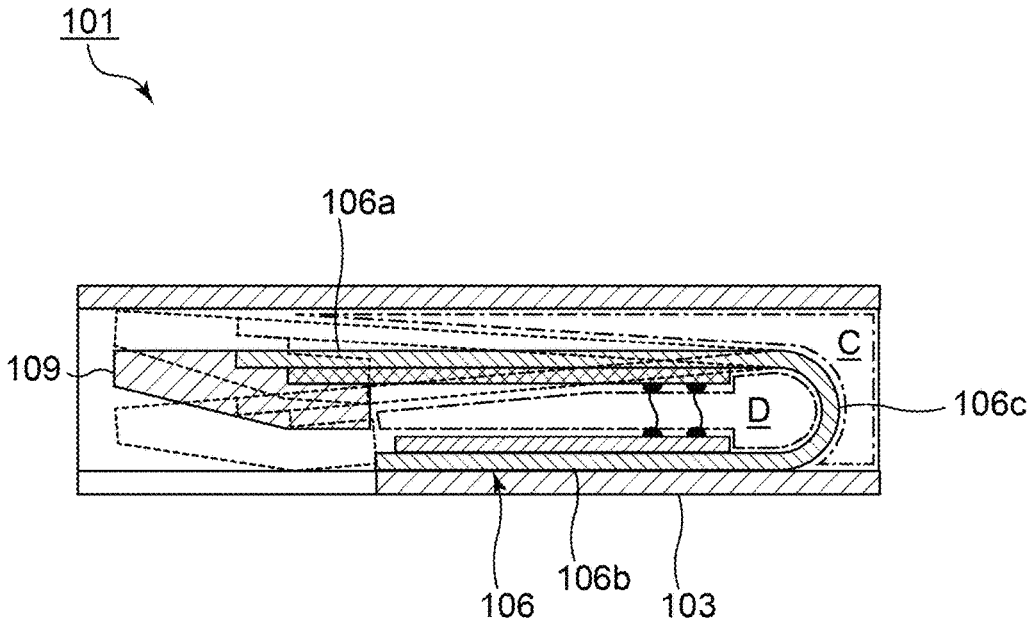
FIG. 7 is a side sectional view schematically illustrating a vibrator device of a comparative example that is vibrating.

FIG. 7 is a side sectional view schematically illustrating a vibrator device of a comparative example that is vibrating.

A vibrator device 101 according to the comparative example includes an elastic plate 106 which bends substantially in a U-like shape. The elastic plate 106 has planar first and second elastic plate portions 106*a* and 106*b*. The first and second elastic plate portions 106*a* and 106*b* are connected to each other by a bent linking portion 106*c*. An added mass member 109 is connected to the forward end of the first elastic plate portion 106*a*. The elastic plate 106 is stored within a package 103. The second elastic plate portion 106*b* is fixed to the package 103.

When the vibrator device 101 is driven, the added mass member 109 vibrates to reciprocate on an arc-like path around a point of the first elastic plate portion 106*a* connected to the bent linking portion 106*c*, as indicated by the broken lines in FIG. 7. The vibrator device 101 of the comparative example includes regions C and D where almost no vibration is produced. The vibration efficiency per unit volume is thus low, and it is difficult to sufficiently reduce the size of the vibrator device 101.

Figure 8:
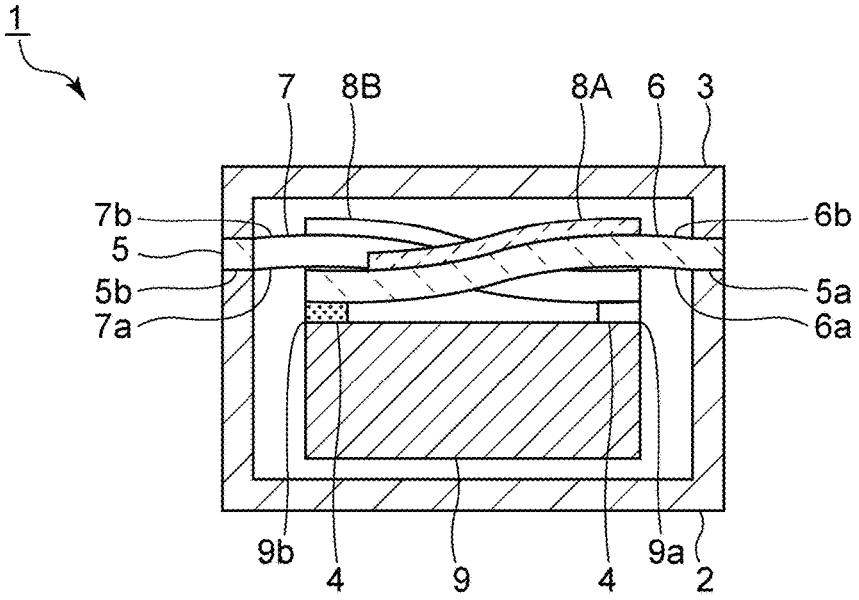
FIG. 8 is a schematic sectional view, corresponding to the sectional view of FIG. 2, illustrating the vibrator device according to the first embodiment of the present invention that is vibrating.
Figure 9:
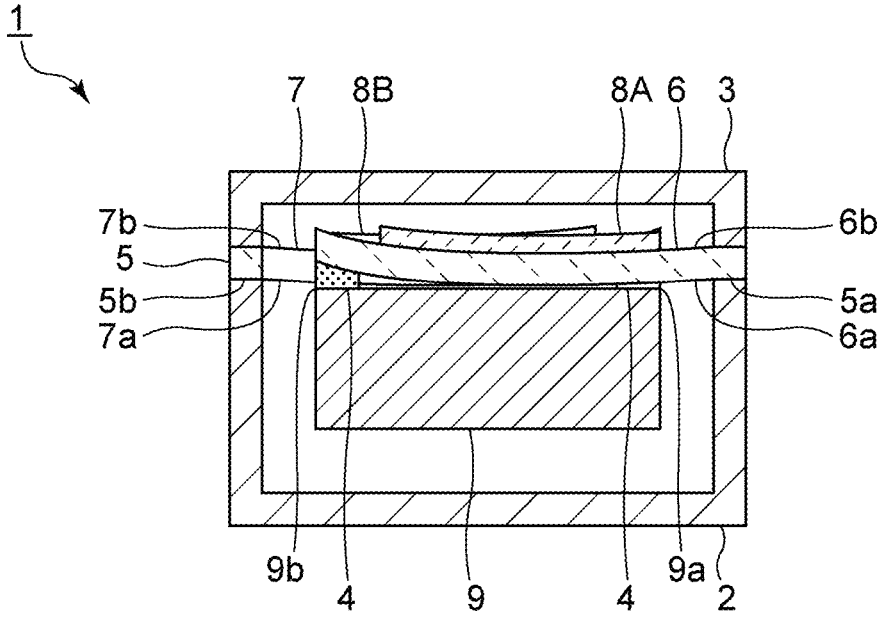
FIG. 9 is a schematic sectional view, corresponding to the sectional view of FIG. 2, illustrating the vibrator device according to the first embodiment of the present invention that is vibrating.

FIGS. 8 and 9 are schematic sectional views, corresponding to the sectional view of FIG. 2, illustrating the vibrator device according to the first embodiment when vibrating.

In FIG. 8, the first and second displacement plates 6 and 7 are displaced toward the first casing member 2. In FIG. 9, the first and second displacement plates 6 and 7 are displaced toward the second casing member 3. Unlike in the comparative example, the first and second displacement plates 6 and 7 are both connected to the added mass member 9 in this embodiment. The added mass member 9 thus vibrates to reciprocate on a path in a straight line in the direction in which the first and second casing members 2 and 3 are connected to each other. In the vibrator device 1, therefore, the first and second displacement plates 6 and 7 and the added mass member 9 vibrate almost in the entire region within the case. This can increase the vibration strength and also effectively reduce the size of the vibrator device 1.

If the vibrator device 1 is dropped to hit the ground, for example, the added mass member 9 vibrates. At this time, when the added mass member 9 is displaced toward the second casing member 3, it collides with the first region A of the first displacement plate 6 and the second region B of the second displacement plate 7, thereby relaxing the vibration. In this manner, the first and second displacement plates 6 and 7 can serve as stoppers to regulate excessive vibration, thereby making it less likely to break the vibrator device 1.

As shown in FIGS. 2 and 3, it is preferable that the first and second displacement plates 6 and 7 be disposed point-symmetrically to each other with respect to the center of the support member 5, as viewed from above. It is more preferable that the center of the support member 5 coincide with the center of gravity of the added mass member 9, as viewed from above. Alternatively, the first and second displacement plates 6 and 7 are preferably disposed point-symmetrically to each other with respect to the center of gravity of the added mass member 9, as viewed from above. This can easily control the vibration behavior of the added mass member 9 to cause it to more reliably vibrate on the above-described path in a straight line. Additionally, an excitation force generated from the vibrator device can be transmitted to outside more efficiently.

As in this embodiment, it is preferable that the first and second displacement plates 6 and 7 overlap each other, as viewed from a direction parallel with the extending direction of the first side portion 5*a*. It is also preferable that both the first and second displacement plates 6 and 7 overlap the center of the support member 5, as viewed from this direction. With this configuration, the first and second displacement plates 6 and 7 are sufficiently long. This can increase the vibration strength and also effectively reduce the size of the vibrator device 1.

The added mass member 9 may not necessarily be connected to the free ends of the first and second displacement plates 6 and 7 if it is connected to portions of the first and second displacement plates 6 and 7 near these free ends. Nevertheless, connecting the added mass member 9 to the free ends of the first and second displacement plates 6 and 7 can enhance the vibration efficiency and effectively reduce the size of the vibrator device 1.

Figure 10:
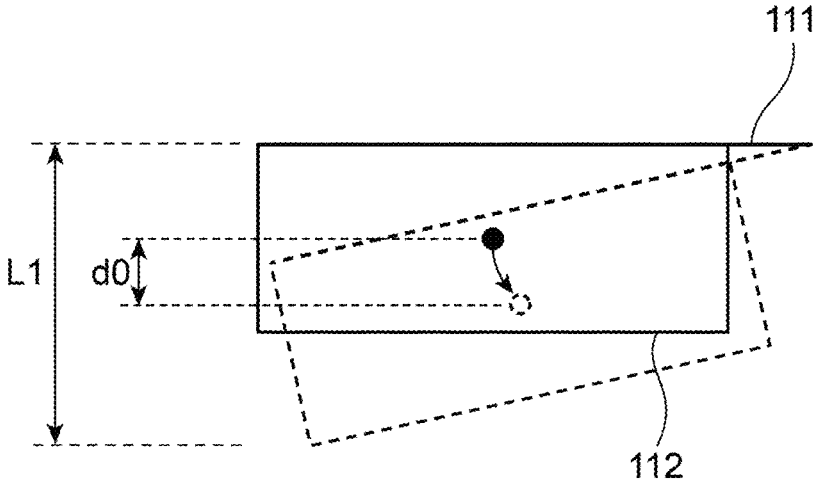
FIG. 10 is a schematic side view for explaining the amount of displacement of an added mass member in a known vibrator device having a cantilever structure.

The relationship between the amount of displacement of an added mass member in a known vibrator device having a cantilever structure and that of the added mass member in this embodiment will be discussed below. FIG. 10 is a schematic side view for explaining the amount of displacement of an added mass member in a known vibrator device having a cantilever structure. In this vibrator device, a displacement plate 111 is supported in a cantilever structure. An added mass member 112 is fixed to the bottom surface of the displacement plate 111. In FIG. 10, the black circle and the broken-line white circle indicate the position of the center of gravity. It is now assumed that the displacement plate 111 is displaced from the state indicated by the solid lines to that indicated by the broken lines. In this case, the displacement of the added mass member is d0, and the amount of vertical displacement of the center of gravity of the displacement plate 111 and the added mass member 112 is 11.

Figure 11:
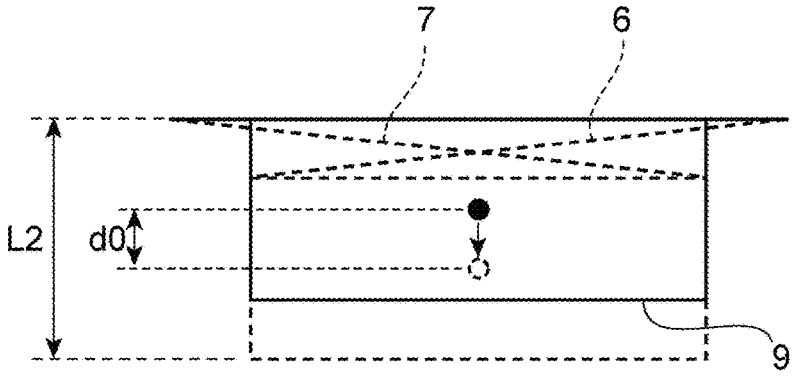
FIG. 11 is a schematic side view for explaining the amount of displacement of an added mass member in the vibrator device according to the first embodiment.

In contrast, in the vibrator device according to this embodiment, the added mass member 9 is displaced, as shown in the schematic side view of FIG. 11. In this case, when the vertical displacement of the center of gravity of the added mass member 9 is d0, the amount of vertical displacement of the added mass member 9 is L2.

FIGS. 10 and 11 illustrate the displacement of the added mass members to produce a vertical driving force. The driving force is proportional to the mass of the added mass member and the amount of displacement of the center of gravity of the added mass member. It is seen from FIGS. 10 and 11 that L2<L1. In this embodiment, therefore, a larger driving force can be obtained by using a smaller space.

If added mass members are individually provided for first and second displacement plates, the vibration timing of the added mass member for the first displacement plate and that for the second displacement plate may deviate from each other. In this case, driving forces may partially cancel out each other, thereby failing to produce a large driving force. In contrast, in this embodiment, the single added mass member 9 is connected to the first and second displacement plates 6 and 7, and the situation where driving forces partially cancel out each other can be avoided.

The surface of the added mass member 9 connected to the first and second displacement plates 6 and 7 has first and second end portions 9*a* and 9*b*. The first end portion 9*a* is positioned proximal to the first side portion 5*a* of the support member 5. The second end portion 9*b* is positioned proximal to the second side portion 5*b* of the support member 5. In the vibrator device 1, the first displacement plate 6 is connected to part of the added mass member 9 including the second end portion 9*b*, while the second displacement plate 7 is connected to part of the added mass member 9 including the first end portion 9*a*. This configuration can increase the amount by which the added mass member 9 overlaps the first and second displacement plates 6 and 7, as viewed from above. As a result, the size of the vibrator device 1 can further be reduced. The positions of the portions of the added mass member 9 connected to the first and second displacement plates 6 and 7 are not limited to the above-described positions.

The first piezoelectric vibrator element 8A is preferably disposed on the second main surface 6*b* of the first displacement plate 6. With this configuration, when the first displacement plate 6 and the added mass member 9 are displaced toward the second casing member 3, the first displacement plate 6 and the first piezoelectric vibrator element 8A are less likely to collide with each other, thereby making it less likely to break the first piezoelectric vibrator element 8A. The first piezoelectric vibrator element 8A may alternatively be disposed on the first main surface 6*a* so as to form a unimorph vibrator with the first displacement plate 6. The position of the second piezoelectric vibrator element 8B on the second displacement plate 7 is similar to that of the first piezoelectric vibrator 8A.

A piezoelectric vibrator element may be disposed on both the first and second main surfaces 6*a* and 6*b* of the first displacement plate 6 so as to form a bimorph vibrator. Likewise, a piezoelectric vibrator element may be disposed on both the first and second main surfaces 7*a* and 7*b* of the second displacement plate 7 so as to form a bimorph vibrator.

As discussed above, in this embodiment, the added mass member 9 is connected to the first and second displacement plates 6 and 7 by using the multiple connecting members 4. In this structure, the first and second displacement plates 6 and 7 include portions which oppose the added mass member 9 with a gap G therebetween. More specifically, the first displacement plate 6 opposes the added mass member 9 in the first region A other than the portion connected to the added mass member 9, while the second displacement plate 7 opposes the added mass member 9 in the second region B other than the portion connected to the added mass member 9. This can enhance the displacement of the added mass member 9 toward the second casing member 3, thereby effectively increasing the vibration strength.

The provision of the connecting members 4 on the added mass member 9 may be omitted, and instead, the added mass member 9 may be connected to the first and second displacement plates 6 and 7 with an adhesive, for example.

As in this embodiment, the vibrator device 1 preferably includes a case constituted by the support member 5 and the first and second casing members 2 and 3, and the first and second displacement plates 6 and 7 and the added mass member 9 are preferably stored in the case. This makes it less likely to break the first and second displacement plates 6 and 7.

As multiple displacement plates, the vibrator device 1 in this embodiment includes the first and second displacement plates 6 and 7. The vibrator device 1 may include displacement plates connected to the added mass member 9 other than the first and second displacement plates 6 and 7, or may include three or more displacement plates.

Figure 12:
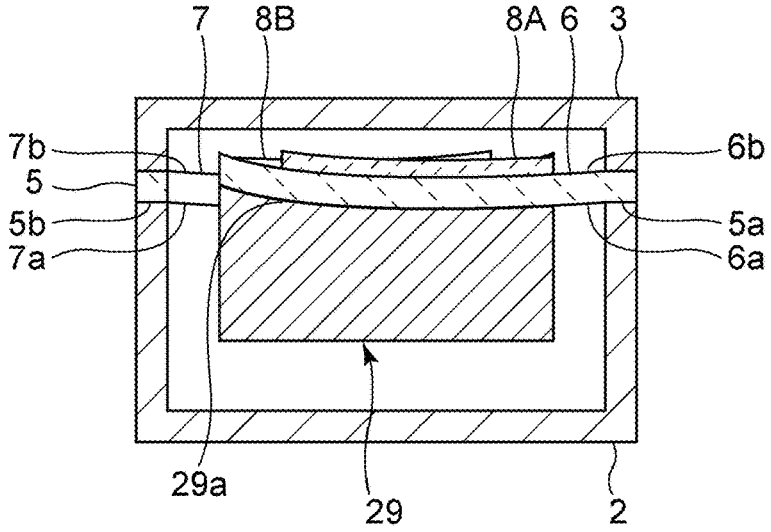
FIG. 12 is a schematic sectional view, corresponding to the sectional view of FIG. 2, illustrating a vibrator device according to a second embodiment of the present invention that is vibrating.
Figure 13:
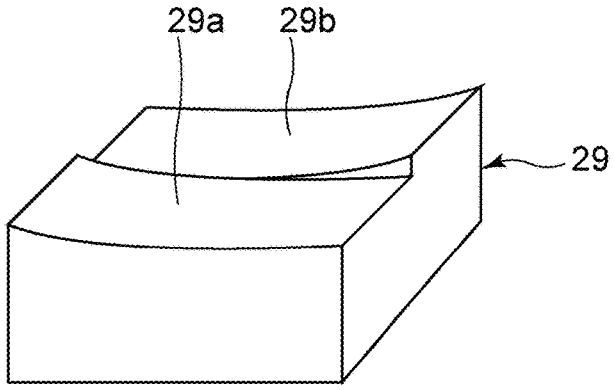
FIG. 13 is a perspective view of an added mass member in the second embodiment of the present invention.

FIG. 12 is a schematic sectional view, corresponding to the sectional view of FIG. 2, illustrating a vibrator device according to a second embodiment that is vibrating. FIG. 13 is a perspective view of an added mass member in the second embodiment.

As shown in FIG. 12, this embodiment is different from the first embodiment in that connecting members are not provided and the shape of the surface of an added mass member 29 which opposes the first and second displacement plates 6 and 7 is different. Except for these points, the configuration of the vibrator device of this embodiment is similar to that of the first embodiment.

A first tilting portion 29*a* is provided in the area where the added mass member 29 opposes the first displacement plate 6. A second tilting portion 29*b* shown in FIG. 13 is provided in the area where the added mass member 29 opposes the second displacement plate 7.

When the free ends of the first and second displacement plates 6 and 7 are displaced toward the second casing member 3, the added mass member 29 is displaced toward the first and second displacement plates 6 and 7. When the first displacement plate 6 is fully displaced in this direction, the shape of the portion of the first displacement plate 6 opposing the added mass member 29 is the same as that of the first tilting portion 29*a*. Likewise, when the second displacement plate 7 is fully displaced toward the second casing member 3, the shape of the portion of the second displacement plate 7 opposing the added mass member 29 is the same as that of the second tilting portion 29*b*. This can further enhance the displacement of the added mass member 29 toward the second casing member 3, thereby further increasing the vibration strength.

The added mass member 29 is connected to the first and second displacement plates 6 and 7 by an adhesive. Alternatively, connecting members similar to those in the first embodiment may be used to connect the added mass member 29 to the first and second displacement plates 6 and 7.

In this embodiment, too, the first and second displacement plates 6 and 7 and the added mass member 29 vibrate almost in the entire region within the case. This can effectively reduce the size of the vibrator device.

Figure 14:
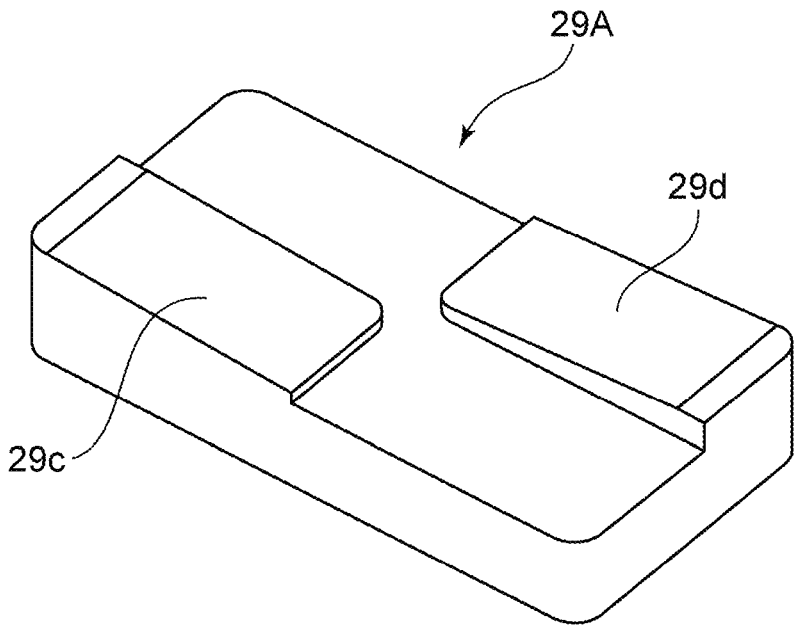
FIG. 14 is a perspective view of an added mass member used in a vibrator device according to a third embodiment of the present invention.
Figure 15:
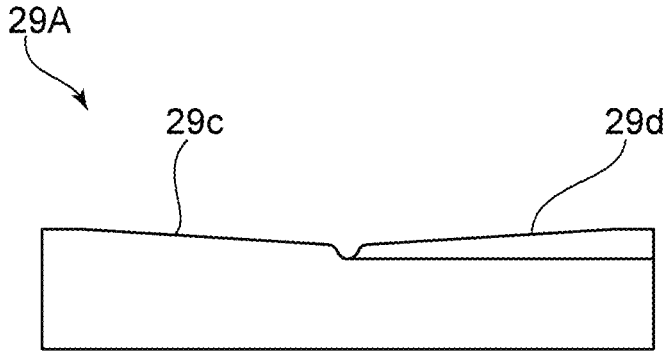
FIG. 15 is a side view of the added mass member used in the vibrator device according to the third embodiment of the present invention.

FIG. 14 is a perspective view of an added mass member used in a vibrator device according to a third embodiment of the present invention. FIG. 15 is a side view of this added mass member.

The shape of the surface of an added mass member 29A opposing the first and second displacement plates 6 and 7 is similar to that of the added mass member 29 used in the second embodiment.

That is, the added mass member 29A has tilting portions 29*c* and 29*d* on the surface opposing the first and second displacement plates 6 and 7. In the area of the added mass member 29A opposing the first displacement plate 6, the tilting portion 29*c* tilts toward the first displacement plate 6 as it advances from the central portion in the connecting direction of the first and second side portions 5*a* and 5*b* toward the second side portion 5*b*. Likewise, in the area of the added mass member 29A opposing the second displacement plate 7, the tilting portion 29*d* tilts toward the second displacement plate 7 as it advances from the central portion in the connecting direction of the first and second side portions 5*a* and 5*b* toward the first side portion 5*a*. The first and second tilting portions 29*c* and 29*d* may be provided to protrude upward from the flat main surface of the added mass member 29A. In this case, the main surface of the added mass member 29A other than the first and second tilting portions 29*c* and 29*d* is flat. The added mass member 29A is thus easier to manufacture than the added mass member 29.

Vibrator devices having narrow width sections according to fourth through sixth embodiments will be described below with reference to FIGS. 17 through 19.

Figure 16:
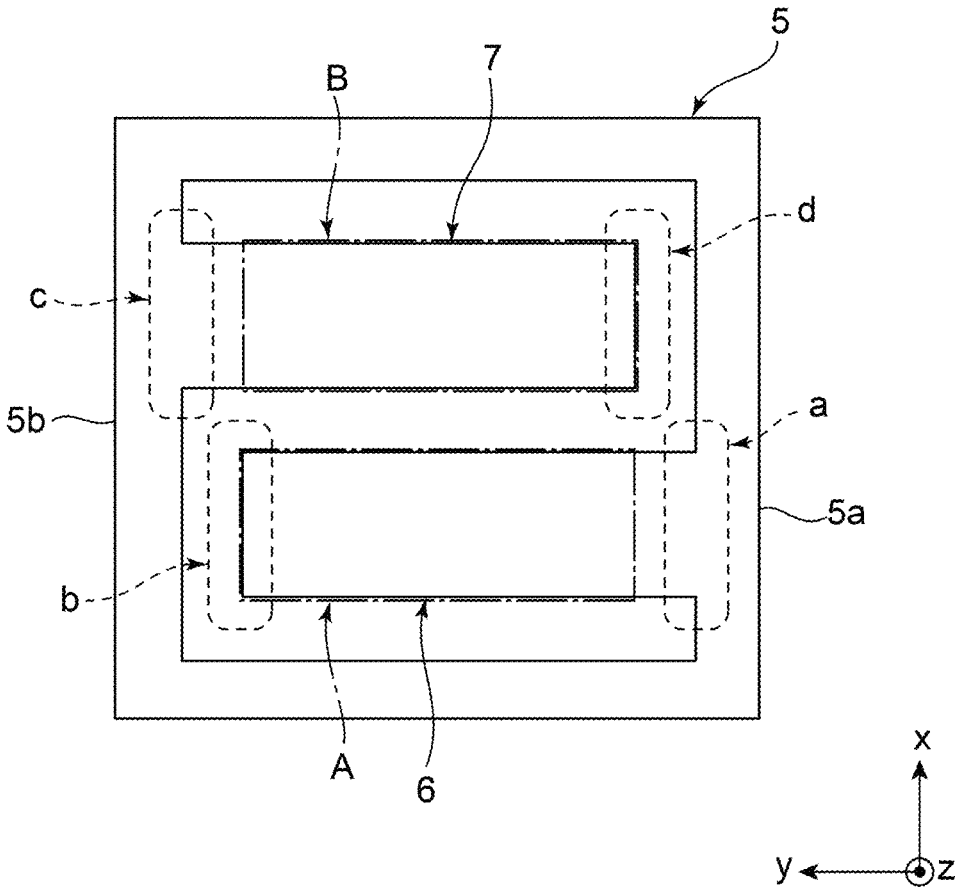
FIG. 16 is a schematic plan view of the vibrator device of the first embodiment.

FIG. 16 is a schematic plan view of the vibrator device of the first embodiment. When the vibrator device of the first embodiment is driven, a stress may be applied to the portions indicated by the arrows a through d in the ±x direction and in the ±y direction in FIG. 16. In the fourth through sixth embodiments, the influence produced by this stress is reduced by the provision of narrow width sections, so that the vibration efficiency can further be enhanced.

In FIG. 16, the x direction is the extending direction of the first and second side portions 5*a* and 5*b*, while the y direction is the extending direction of the first and second displacement plates 6 and 7.

The z direction is a direction in the plane of the drawing of FIG. 16.

Figure 17:
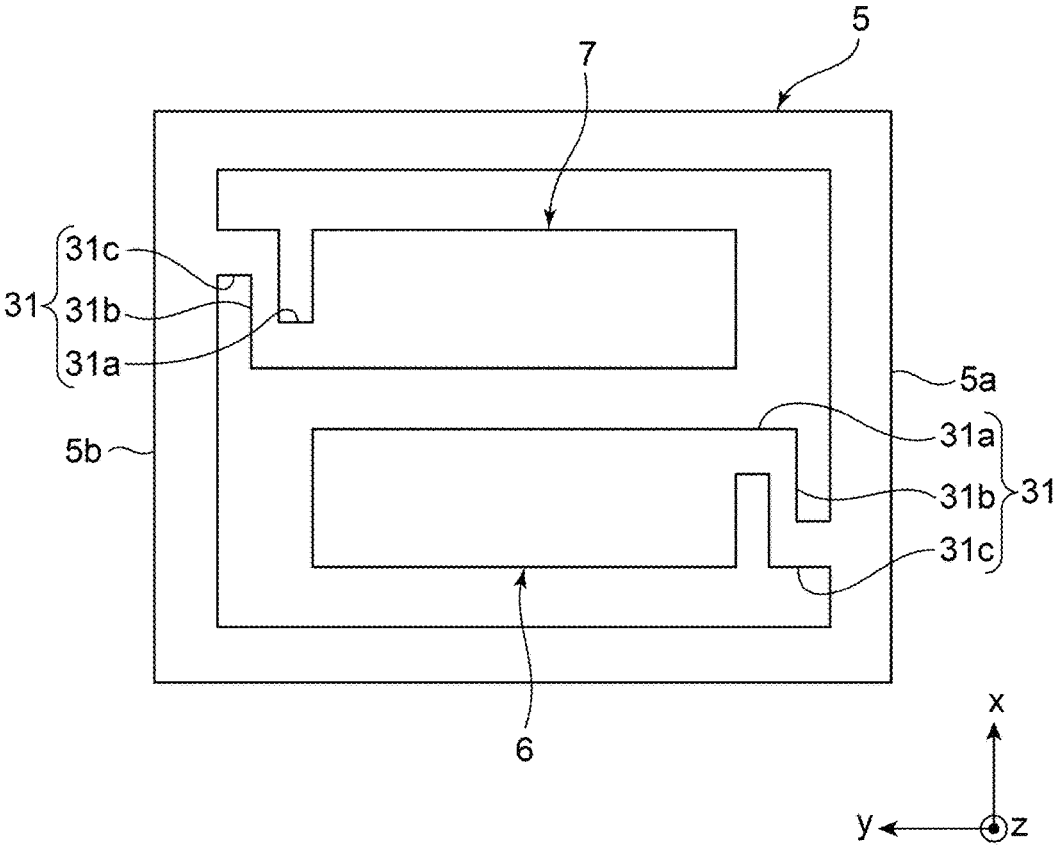
FIG. 17 is a schematic plan view of a vibrator device according to a fourth embodiment of the present invention

In the vibrator device according to the fourth embodiment shown in FIG. 17, a narrow width section 31 is connected between the first side portion 5*a* and the first displacement plate 6. A narrow width section 31 is connected also between the second side portion 5*b* and the second displacement plate 7.

The narrow width section 31 includes first, second, and third portions 31*a*, 31*b*, and 31*c*. The dimensions of the narrow width section 31 in the widthwise direction are smaller than the width of the first displacement plate 6. The widths of the first and second displacement plates 6 and 7 are the dimensions along the x direction, that is, the dimensions extending along the first and second side portions 5*a* and 5*b*. The widths of the narrow width section 31 are the dimensions perpendicular to the extending directions of the narrow width section 31. The first and third portions 31*a* and 31*c* extend in the y direction. The widths of the first and third portions 31*a* and 31*c* are accordingly the dimensions in the x direction. In contrast, the second portion 31*b* extends in the x direction. The width of the second portion 31*b* is accordingly the dimension in the y direction.

The widthwise dimensions of the narrow width section 31 are those of the first, second, and third portions 31*a*, 31*b*, and 31*c*, which are all smaller than the width of the first displacement plate 6. Likewise, the widthwise dimensions of the narrow width section 31 connected between the second side portion 5*b* and the second displacement plate 7 are also smaller than the width of the second displacement plate 7.

In the fourth embodiment, the widthwise dimensions of the narrow width sections 31 are smaller than the widths of the first and second displacement plates 6 and 7, thereby making it possible to relax a stress applied to the portions indicated by the arrows a through d in FIG. 16. That is, the narrow width sections 31 exhibit the effect of relaxing a stress, like a spring. This enables the first and second displacement plates 6 and 7 to vibrate efficiently, thereby effectively enhancing the vibration efficiency of the vibrator device. In other words, to obtain the same level of vibration as that in the first embodiment in FIG. 16, the size of the vibrator device can be reduced.

Even if the vibrator device is dropped and is subjected to an external mechanical shock, the narrow width sections 31 can serve as a spring to relax the applied stress. The shock resistance of the vibrator device can thus be improved.

In each of the narrow width sections 31, the first portion 31*a* is located at a position including the end portion of the corresponding one of the first and second displacement plates 6 and 7 in the x direction, that is, in the widthwise direction. The second portion 31*b* extends from the first portion 31*a* in the x direction, that is, a direction parallel with the extending direction of the first side portion 5*a* or the second side portion 5*b*, and also extends in a direction to be separate from the first portion 31*a* in the x direction. As viewed in the y direction, a linking portion of the second portion 31*b* and the third portion 31*c* overlaps the end portion of the corresponding one of the first and second displacement plates 6 and 7 in the x direction. This configuration enables the narrow width sections 31 to sufficiently exhibit the effect of relaxing a stress without increasing the dimension in the y direction.

Figure 18:
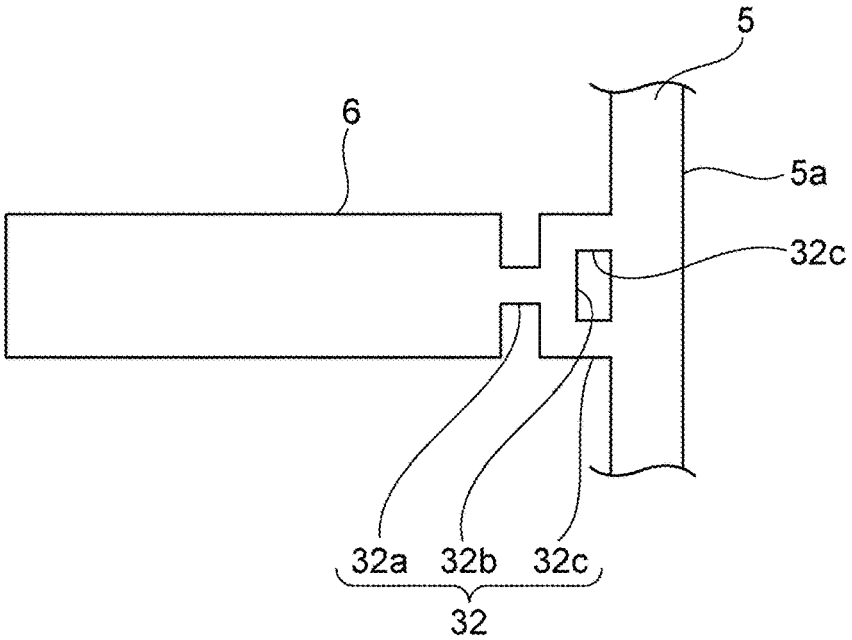
FIG. 18 is a partially cutaway plan view illustrating a first side portion, a first displacement plate, and a narrow width section in a vibrator device according to a fifth embodiment of the present invention.

FIG. 18 is a partially cutaway plan view illustrating the first displacement plate 6, the first side portion 5*a*, and a narrow width section 32 in the vibrator device according to the fifth embodiment. The narrow width section 32 includes first, second, and third portions 32*a*, 32*b*, and 32*c*. The first portion 32*a* extends from the first displacement plate 6 toward the first side portion 5*a*. The width of the first portion 32*a*, that is, the dimension along the extending direction of the first side portion 5*a*, is smaller than the width of the first displacement plate 6. At the end portion of the first displacement plate 6 proximal to the first side portion 5*a*, the first portion 32*a* is linked to the center of the first displacement plate 6 in the widthwise direction.

The second portion 32*b* is linked to the end of the first portion 32*a* opposite the end of the first portion 32*a* linked to the first displacement plate 6. The second portion 32*b* extends in the extending direction of the first side portion 5*a*. One third portion 32*c* is linked to one end of the second portion 32*b* in the extending direction of the first side portion 5*a*, while the other third portion 32*c* is linked to the other end of the second portion 32*b*. The third portions 32*c* extend in the extending direction of the first displacement plate 6 and are connected to the first side portion 5*a*.

As in the fifth embodiment, the narrow width section 32 may include multiple portions connected to the first side portion 5*a*.

In the fifth embodiment, multiple portions of the narrow width section 32 are the third portions. However, the first portion 32*a* and the third portions 32*c* may be reversed. That is, multiple first portions 32*a* may be provided and connected to the first displacement plate 6, while a single third portion 32*c* may be provided and connected to the first side portion 5*a*. In whichever arrangement, the narrow width section 32 includes a connecting portion with the first displacement plate 6 and multiple connecting portions with the first side portion 5*a* or includes multiple connecting portions with the first displacement plate 6 and a connecting portion with the first side portion 5*a*, and none of the connecting portions overlap each other in the extending direction of the first displacement plate 6. This configuration can effectively enhance the vibration efficiency.

The narrow width section 32 provided for the first displacement plate 6 has been discussed with reference to FIG. 18. A structure similar to the narrow width section 32 is also provided for the second displacement plate.

In the fourth and fifth embodiments, the connecting portions of the narrow width sections 31 and 32 with the first displacement plate 6 and the connecting portions with the first side portion 5*a* do not overlap each other in the y direction in FIG. 17, that is, in the extending direction of the first displacement plate 6. Likewise, the connecting portions of the narrow width sections 31 and 32 with the second displacement plate 7 and the connecting portions with the second side portion 5*b* do not overlap each other in the y direction. This can effectively enhance the vibration efficiency.

Additionally, in the fourth and fifth embodiments, the narrow width sections 31 and 32 respectively include the second portions 31*b* and 32*b* extending in parallel with the first and second side portions 5*a* and 5*b*. This also contributes to effectively enhancing the vibration efficiency.

Figure 19:
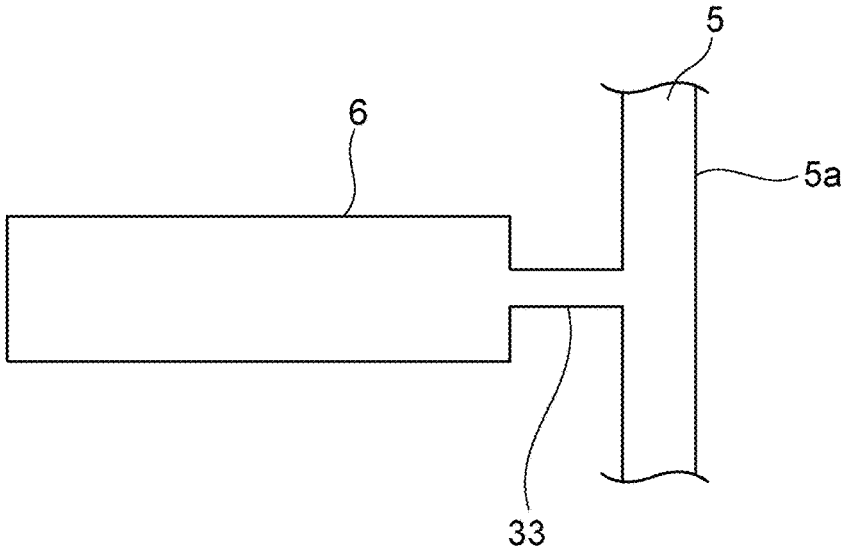
FIG. 19 is a partially cutaway plan view illustrating a first side portion, a first displacement plate, and a narrow width section in a vibrator device according to a sixth embodiment of the present invention.

FIG. 19 is a partially cutaway plan view illustrating a first displacement plate, a first side portion, and a narrow width section in the vibrator device according to the sixth embodiment.

A narrow width section 33 extends in the extending direction of the first displacement plate 6, and is connected at one end to the first displacement plate 6 and at the other end to the first side portion 5*a*. The width of the narrow width section 33, that is, the dimension along the extending direction of the first side portion 5*a*, is smaller than that of the first displacement plate 6. As in the sixth embodiment, the substantially Y-shaped narrow width section 33 may be used. In this case, too, the stress applied to the portions indicated by the arrows a through d shown in FIG. 16 can be relaxed, thereby enhancing the vibration efficiency.

Figure 20:
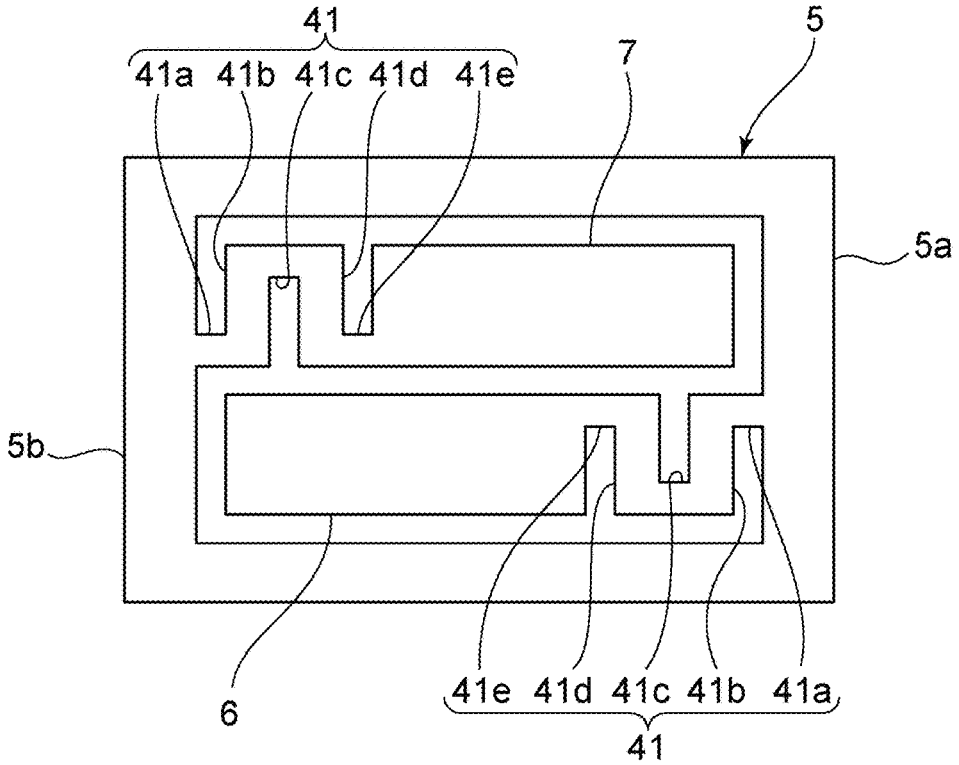
FIG. 20 is a schematic plan view illustrating the major part of a vibrator device according to a seventh embodiment of the present invention.

FIG. 20 is a schematic plan view illustrating the major part of a vibrator device according to a seventh embodiment. In the seventh embodiment, a narrow width section 41 is connected between the first side portion 5*a* and the first displacement plate 6. A narrow width section 41 is connected also between the second side portion 5*b* and the second displacement plate 7. The narrow width section 41 includes first through fifth portions 41*a* through 41*e*. The dimensions of the narrow width sections 41 in the widthwise direction, as well as those of the narrow width section 31, are smaller than the widths of the first and second displacement plates 6 and 7.

The widths of the first and second displacement plates 6 and 7 are the dimensions in the above-described x direction, that is, the dimensions along the extending direction of the first and second side portions 5*a* and 5*b*. The widths of the narrow width sections 41 are the dimensions perpendicular to the extending directions of the narrow width sections 41.

As in the above-described narrow width section 31, the widthwise dimensions of the first through fifth portions 41*a* through 41*e* of the narrow width section 41 are smaller than the widths of the first and second displacement plates 6 and 7.

In the narrow width section 41 between the first displacement plate 6 and the first side portion 5*a*, the first portion 41*a* is connected to the first side portion 5*a*. The second portion 41*b* is linked to the forward end of the first portion 41*a*. The second portion 41*b* extends in parallel with the extending direction of the first side portion 5*a*. The fourth portion 41*d* also extends in parallel with the first side portion 5*a*. The second and fourth portions 41*b* and 41*d* are linked with each other by the third portion 41*c* extending in the direction in which the first and second side portions 5*a* and 5*b* are connected.

The forward end of the fourth portion 41*d* is linked to the first displacement plate 6 via the fifth portion 41*e*. The fifth portion 41*e* extends in the direction in which the first and second side portions 5*a* and 5*b* are connected.

As is seen from the seventh embodiment, a narrow width section may be formed in a shape in which a portion along the connecting direction of the first and second side portions 5*a* and 5*b* and a portion extending in a direction perpendicular to the first side portion 5*a* are repeated multiple times.

Figure 21:
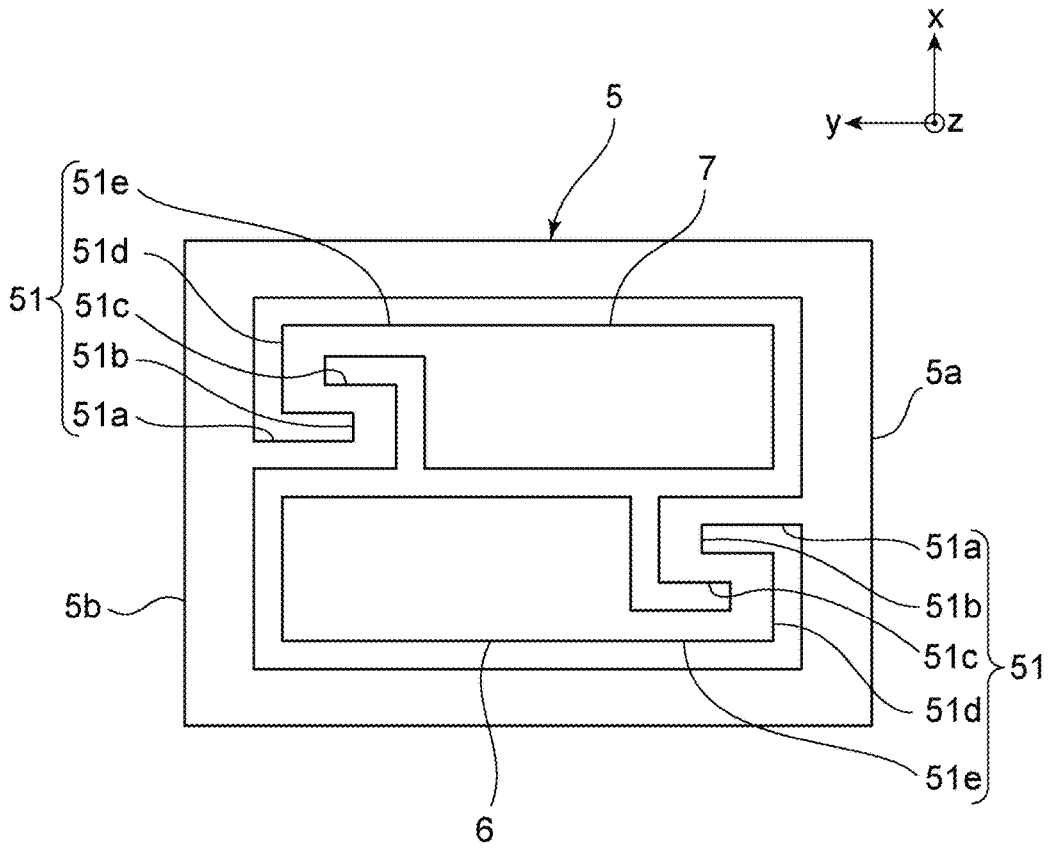
FIG. 21 is a schematic plan view illustrating the major part of a vibrator device according to an eighth embodiment of the present invention.

FIG. 21 is a schematic plan view illustrating the major part of a vibrator device according to an eighth embodiment. In this embodiment, a narrow width section 51 includes first through fifth portions 51*a* through 51*e*. The first portion 51*a* extends in the y direction in FIG. 21. The second portion 51*b* extends in the x direction in FIG. 21. The third portion 51*c* extends in the y direction. The fourth portion 51*d* extends in the x direction. The fifth portion 51*e* extends in the y direction. The third portion 51*c* extends to return from the first displacement plate 6 toward the first side portion 5*a* in the y direction. In the second displacement plate 7, too, the third portion 51*c* extends from the second displacement plate 7 toward the second side portion 5*b*. In this manner, portions extending in the y direction may extend in a direction to be separate from the first and second displacement plates 6 and 7.

Figure 22:
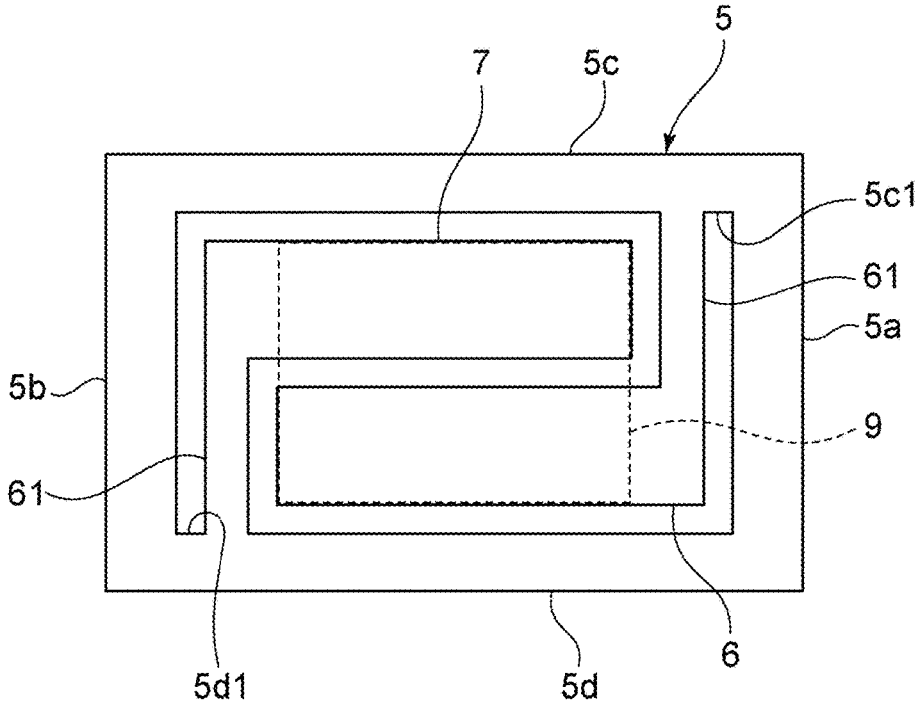
FIG. 22 is a schematic plan view illustrating the major part of a vibrator device according to a reference example.

FIG. 22 is a schematic plan view illustrating the major part of a vibrator device according to a reference example. A support member 5 has third and fourth side portions 5*c* and 5*d* which connect first and second side portions 5*a* and 5*b*. The first displacement plate 6 is connected to a linking portion 5*c*1, which is part of the third side portion 5*c*, via a narrow width section 61. Hence, the first displacement plate 6 is connected to the first side portion 5*a* via the narrow width section 61 and the linking portion 51*c*1. Similarly, the second displacement plate 7 is connected to the second side portion 5*b* via a narrow width section 61 and a linking portion 5*d*1, which is part of the fourth side portion 5*d*. In this manner, the first and second displacement plates 6 and 7 may be connected indirectly to the first and second side portions 5*a* and 5*b*, respectively.

Figure 23:
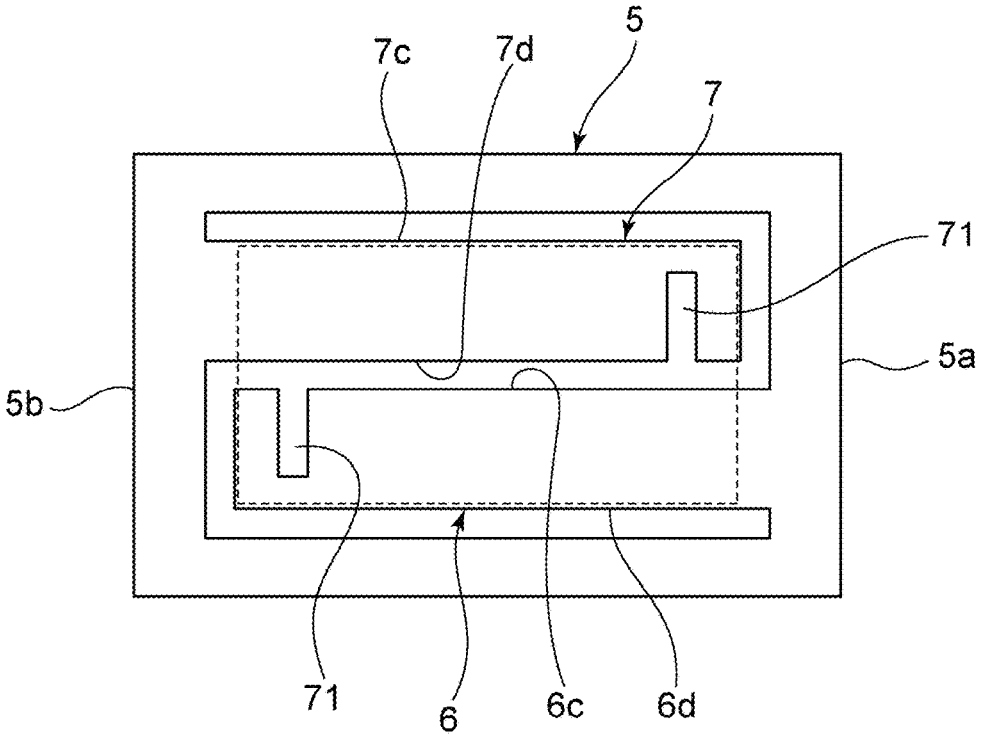
FIG. 23 is a schematic plan view illustrating the major part of a vibrator device according to a ninth embodiment of the present invention.

FIG. 23 is a schematic plan view illustrating the major part of a vibrator device according to a ninth embodiment. A notch 71 is provided in each of the first and second displacement plates 6 and 7. The first displacement plate 6 has a pair of side surfaces 6*c* and 6*d*, while the second displacement plate 7 has a pair of side surfaces 7*c* and 7*d*. The side surfaces 6*c* and 6*d* extend in a direction in which the first and second side portions 5*a* and 5*b* are connected. The side surfaces 7*c* and 7*d* also extend in the direction in which the first and second side portions 5*a* and 5*b* are connected. In the first displacement plate 6, the notch 71 is provided to be open toward the side surface 6*c*. In the second displacement plate 7, the notch 71 is provided to be open toward the side surface 7*d*. In this manner, a notch 71 may be provided in part of each of the first and second displacement plates 6 and 7 so as to be open toward one of the side surfaces.

Multiple notches 71 may be provided in each of the first and second displacement plates 6 and 7. A notch 71 may be provided on either side of the side surfaces 6*c* and 6*d* or on both the side surfaces 6*c* and 6*d*. In the second displacement plate 7, too, a notch 71 may be provided on both the side surfaces 7*c* and 7*d*.

In the vibrator device according to the present invention, as viewed from above, at least part of a portion of the first displacement plate positioned proximal to the first side portion relative to the portion of the first displacement plate connected to the added mass member preferably overlaps the added mass member. As viewed from above, at least part of a portion of the second displacement plate positioned proximal to the second side portion relative to the portion of the second displacement plate connected to the added mass member preferably overlaps the added mass member.

In the present invention, the first and second displacement plates preferably overlap each other, as viewed from a direction parallel with the extending direction of the first side portion of the support member. With this configuration, the first and second displacement plates are sufficiently long. This can make the first and second displacement plates bend by a greater amount in response to the piezoelectric vibrator elements. That is, the strength of vibration produced in the vibrator device can be increased, and the size of the vibrator device can further be reduced.

In the vibrator device according to the present invention, the added mass member may be connected to the free end of the first displacement plate and that of the second displacement plate. With this configuration, the vibration efficiency can be enhanced, and the size of the vibrator device can further be reduced.

In the vibrator device according to the present invention, the surface of the added mass member connected to the first and second displacement plates preferably has first and second end portions. The first end portion is positioned proximal to the first side portion of the support member, and the second end portion is positioned proximal to the second side portion of the support member. The first displacement plate is preferably connected to a portion including part of the second end portion, while the second displacement plate is preferably connected to a portion including part of the first end portion. With this configuration, as viewed from above, the amount by which the added mass member overlaps the first and second displacement plates can be increased. As a result, the size of the vibrator device can further be reduced.

In the vibrator device according to the present invention, as viewed from above, the first and second displacement plates may be disposed point-symmetrically to each other with respect to the center of gravity of the added mass member. With this configuration, an excitation force generated from the vibrator device can be transmitted to outside efficiently.

In the vibrator device according to the present invention, the dimensions of the first and second displacement plates along the extending direction of the first and second side portions are assumed as the widths of the first and second displacement plates. A narrow width section is preferably connected between the first displacement plate and the first side portion. The width of the narrow width section is smaller than that of the first displacement plate. A narrow width section is preferably connected between the second displacement plate and the second side portion. The width of the narrow width section is smaller than that of the second displacement plate. With this configuration, the vibration efficiency can further be enhanced.

In the vibrator device according to the present invention, as viewed from a direction perpendicular to the extending direction of the first side portion, a connecting portion between the narrow width section and the first displacement plate and a connecting portion between the narrow width section and the second side portion preferably do not overlap each other. A connecting portion between the narrow width section and the second displacement plate and a connecting portion between the narrow width section and the first side portion preferably do not overlap each other. With this configuration, the vibration efficiency can be enhanced more effectively.

In the vibrator device according to the present invention, preferably, the narrow width section connected between the first displacement plate and the first side portion includes a connecting portion between the narrow width section and the first displacement plate and multiple connecting portions between the narrow width section and the first side portion, or includes multiple connecting portions between the narrow width section and the first displacement plate and a connecting portion between the narrow width section and the first side portion. Preferably, the narrow width section connected between the second displacement plate and the second side portion includes a connecting portion between the narrow width section and the second displacement plate and multiple connecting portions between the narrow width section and the second side portion, or includes multiple connecting portions between the narrow width section and the second displacement plate and a connecting portion between the narrow width section and the second side portion. Preferably, none of the connecting portions overlap each other as viewed from a direction perpendicular to the extending direction of the first and second side portions and from the extending direction of the first and second displacement plates. With this configuration, the vibration efficiency can be enhanced even more effectively.

In the vibrator device according to the present invention, the narrow width section connected between the first displacement plate and the first side portion may include a portion extending in parallel with the first side portion, while the narrow width section connected between the second displacement plate and the second side portion may include a portion extending in parallel with the second side portion. With this configuration, the vibration efficiency can further be enhanced.

In the vibrator device according to the present invention, a connecting portion between the narrow width section and the first displacement plate may include an end portion of the first displacement plate in the extending direction of the first side portion. A connecting portion between the narrow width section and the second displacement plate may include an end portion of the second displacement plate in the extending direction of the second side portion. With this configuration, the vibration efficiency can be enhanced even more effectively.

In the vibrator device according to the present invention, each of the narrow width sections preferably includes first, second, and third portions. The first portion is linked to a widthwise end portion of a corresponding one of the first and second displacement plates and extends in the extending direction of the corresponding one of the first and second displacement plates. The second portion is linked to the end of the first portion opposite the end of the first portion connected to the corresponding one of the first and second displacement plates and extends in the extending direction of the corresponding one of the first and second side portions. The third portion is linked to the end of the second portion opposite the end of the second portion linked to the first portion, extends in the extending direction of the corresponding one of the first and second displacement plates, and is linked to the corresponding one of the first and second side portions. With this configuration, the vibration efficiency can be enhanced more effectively.

In the vibrator device according to the present invention, each of the first and second displacement plates preferably has a pair of side surfaces extending perpendicularly to the extending direction of the first and second side portions. A notch is preferably provided in each of the first and second displacement plates. The notch provided in the first displacement plate is open toward one of the side surfaces, and the notch provided in the second displacement plate is open toward one of the side surfaces.

In the vibrator device according to the present invention, the first and second displacement plates and the support member are preferably formed integrally. In this case, vibration can be transmitted, not through different materials, but through the same material, thereby enhancing the efficiency in transmitting vibration. Additionally, a breakage, such as a fatigue fracture, is less likely to occur in the portion of the first displacement plate supported by the support member and the portion of the second displacement plate supported by the support member.

In the vibrator device according to the present invention, the first and second displacement plates, the narrow width sections, and the support member may be formed integrally.

In the vibrator device according to the present invention, each of the first and second displacement plates preferably has first and second main surfaces which oppose each other. The added mass member is preferably connected to the first main surface of the first displacement plate and that of the second displacement plate. The first piezoelectric vibrator element is preferably disposed on the second main surface of the first displacement plate, while the second piezoelectric vibrator element is preferably disposed on the second main surface of the second displacement plate. With this configuration, the first and second displacement plates and the respective piezoelectric vibrator elements are less likely to collide with each other, thereby making it less likely to break the piezoelectric vibrator elements.

In the vibrator device according to the present invention, multiple connecting members are preferably disposed on the added mass member. The added mass member is preferably connected to the first and second displacement plates by using the multiple connecting members. Each of the first and second displacement plates preferably has a portion which opposes the added mass member with a gap therebetween. With this configuration, the displacement of the added mass member can be enhanced, thereby effectively enhancing the vibration efficiency.

In the vibrator device according to the present invention, when the first displacement plate is fully displaced in a direction in which the added mass member is displaced toward the first and second displacement plates, the shape of a portion of the first displacement plate which opposes the added mass member is preferably identical to that of a portion of the added mass member which opposes the first displacement plate. When the second displacement plate is fully displaced in a direction in which the added mass member is displaced toward the first and second displacement plates, the shape of a portion of the second displacement plate which opposes the added mass member is preferably identical to that of a portion of the added mass member which opposes the second displacement plate. With this configuration, the displacement of the added mass member can be enhanced, thereby effectively enhancing the vibration efficiency.

In the vibrator device according to the present invention, on the main surface of the added mass member proximal to the first and second displacement plates, in the area of the added mass member which opposes the first displacement plate, a first tilting portion is preferably provided to tilt toward the first displacement plate as it advances from the central portion in the connecting direction of the first and second side portions toward the second side portion. In the area of the added mass member which opposes the second displacement plate, a second tilting portion is preferably provided to tilt toward the second displacement plate as it advances from the central portion in the connecting direction of the first and second side portions toward the first side portion.

The vibrator device according to the present invention preferably further include first and second casing members. The support member is preferably disposed between the first and second casing members. The first and second displacement plates and the added mass member are preferably stored within a case. The case is constituted by the first and second casing members and the support member. With this configuration, the first and second displacement plates, for example, are less likely to be broken.

REFERENCE SIGNS LIST

1 vibrator device
2, 3 first and second casing members
4 connecting member
5 support member
5*a*, 5*b* first and second side portions
6 first displacement plate
6*a*, 6*b* first and second main surfaces
7 second displacement plate
7*a*, 7*b* first and second main surfaces
8A, 8B first and second piezoelectric vibrator elements
9 added mass member
9*a*, 9*b* first and second end portions
12 piezoelectric multilayer body
12*a*, 12*b* first and second main surfaces
12*c* side surface
13, 14 first and second inner electrodes
15, 16 first and second connecting electrodes
17, 18 first and second outer electrodes
29, 29A added mass member
29*a*, 29*b* first and second tilting portions
29*c*, 29*d* tilting portion
31, 32, 33 narrow width section
31*a*, 32*a* first portion
31*b*, 32*b* second portion
31*c*, 32*c* third portion
41, 51, 61 narrow width section
41*a* to 41*e*, 51*a* to 51*e* first through fifth portions
71 notch
101 vibrator device
103 package
106 elastic plate
106*a*, 106*b* first and second elastic plate portions
106*c* bent linking portion
109 added mass member
111 displacement plate
112 added mass member

The invention claimed is:

1. A vibrator device comprising:

a support member having first and second side portions which oppose each other;

a first displacement plate supported by the first side portion of the support member and extending toward the second side portion so as to have a first free end;

a second displacement plate supported by the second side portion of the support member and extending toward the first side portion so as to have a second free end;

a first piezoelectric vibrator element on the first displacement plate;

a second piezoelectric vibrator element on the second displacement plate; and an added mass member connected to a portion of the first displacement plate proximal to the first free end relative to the first side portion of the support member and connected to a portion of the second displacement plate proximal to the second free end relative to the second side portion of the support member.

2. The vibrator device according to claim 1, wherein:

as viewed from a direction of stacking of the support member and the added mass member, at least part of a portion of the first displacement plate proximal to the first side portion than to the portion of the first displacement plate connected to the added mass member overlaps the added mass member; and as viewed from the direction of stacking of the support member and the added mass member, at least part of a portion of the second displacement plate proximal to the second side portion than to the portion of the second displacement plate connected to the added mass member overlaps the added mass member.

3. The vibrator device according to claim 1, wherein the first and second displacement plates overlap each other as viewed from a direction parallel with an extending direction of the first side portion of the support member.

4. The vibrator device according to claim 1, wherein the added mass member is connected at the first free end of the first displacement plate and at the second free end of the second displacement plate.

5. The vibrator device according to claim 1, wherein:

a surface of the added mass member connected to the first and second displacement plates has first and second end portions, the first end portion positioned proximal to the first side portion of the support member, the second end portion positioned proximal to the second side portion of the support member; and the first displacement plate is connected to at least part of the second end portion, and the second displacement plate is connected to at least part of the first end portion.

6. The vibrator device according to claim 1, wherein, as viewed from the direction of stacking of the support member and the added mass member, the first and second displacement plates are disposed point-symmetrically to each other with respect to a center of gravity of the added mass member.

7. The vibrator device according to claim 1, further comprising:

a first narrow width section between the first displacement plate and the first side portion, wherein a width of the first narrow width section along an extending direction of the first and second side portions is smaller than a width of the first displacement plate along the extending direction of the first and second side portions; and a second narrow width section between the second displacement plate and the second side portion, wherein a width of the second narrow width section along the extending direction of the first and second side portions is smaller than the width of the second displacement plate along the extending direction of the first and second side portions.

8. The vibrator device according to claim 7, wherein:

as viewed from a direction perpendicular to the extending direction of the first side portion, a first connecting portion between the first narrow width section and the first displacement plate and a second connecting portion between the first narrow width section and the first side portion do not overlap each other; and a third connecting portion between the second narrow width section and the second displacement plate and a fourth connecting portion between the second narrow width section and the second side portion do not overlap each other.

9. The vibrator device according to claim 7, wherein:

the first narrow width section between the first displacement plate and the first side portion includes a first connecting portion between the first narrow width section and the first displacement plate and a plurality of second connecting portions between the first narrow width section and the first side portion or includes a plurality of first connecting portions between the first narrow width section and the first displacement plate and a second connecting portion between the first narrow width section and the first side portion; and the second narrow width section between the second displacement plate and the second side portion includes a third connecting portion between the second narrow width section and the second displacement plate and a plurality of fourth connecting portions between the second narrow width section and the second displacement plate or includes a plurality of third connecting portions between the second narrow width section and the second displacement plate and a fourth connecting portion between the second narrow width section and the second side portion, wherein none of the first, second, third or fourth connecting portions overlap each other as viewed from a direction perpendicular to the extending direction of the first and second side portions and from an extending direction of the first and second displacement plates.

10. The vibrator device according to claim 7, wherein the first narrow width section between the first displacement plate and the first side portion includes a portion extending in parallel with the first side portion, and the second narrow width section between the second displacement plate and the second side portion includes a portion extending in parallel with the second side portion.

11. The vibrator device according to claim 7, wherein:

a first connecting portion between the first narrow width section and the first displacement plate is positioned at an end portion of the first displacement plate in an extending direction of the first side portion; and a second connecting portion between the second narrow width section and the second displacement plate is positioned at an end portion of the second displacement plate in an extending direction of the second side portion.

12. The vibrator device according to claim 7, wherein the first narrow width section includes first, second and third portions, the first portion being linked to a widthwise end portion of the first displacement plate and extending in an extending direction of the first displacement plate, the second portion being linked to an end of the first portion opposite an end of the first portion connected to the first displacement plate and extending in an extending direction of the first side portion, and the third portion being linked to an end of the second portion opposite an end of the second portion linked to the first portion, extends in the extending direction of the first displacement plate, and linked to the first side portion; and the second narrow width section includes fourth, fifth and sixth portions, the fourth portion being linked to a widthwise end portion of the second displacement plate and extending in an extending direction of the second displacement plate, the fifth portion being linked to an end of the fourth portion opposite an end of the fourth portion connected to the second displacement plate and extending in an extending direction of the second side portion, and the sixth portion being linked to an end of the fifth portion opposite an end of the fifth portion linked to the fourth portion, extends in the extending direction of the second displacement plate, and linked to the second side portion.

13. The vibrator device according to claim 7, wherein the first and second displacement plates, the first and second narrow width sections, and the support member are integral.

14. The vibrator device according to claim 1, wherein each of the first and second displacement plates has a pair of side surfaces extending perpendicular to an extending direction of the first and second side portions, the first displacement plate including a first notch open toward one of the pair of side surfaces, and the second displacement plate including a second notch open toward one of the pair of side surfaces.

15. The vibrator device according to claim 1, wherein the first and second displacement plates and the support member are integral.

16. The vibrator device according to claim 1, wherein:

each of the first and second displacement plates has first and second main surfaces which oppose each other;

the added mass member is connected to the first main surface of the first displacement plate and the first main surface of the second displacement plate; and the first piezoelectric vibrator element is on the second main surface of the first displacement plate, and the second piezoelectric vibrator element is on the second main surface of the second displacement plate.

17. The vibrator device according to claim 1, further comprising:

a plurality of connecting members arranges so as to connect the added mass member to the first and second displacement plates such that each of the first and second displacement plates has a portion thereof which opposes the added mass member with a gap therebetween.

18. The vibrator device according to claim 1, wherein:

a first shape of a portion of the first displacement plate which opposes the added mass member is identical to a second shape of a portion of the added mass member which opposes the first displacement plate when the first displacement plate is fully displaced in a direction in which the added mass member is displaced toward the first and second displacement plates; and a third shape of a portion of the second displacement plate which opposes the added mass member is identical to a fourth shape of a portion of the added mass member which opposes the second displacement plate when the second displacement plate is fully displaced in the direction in which the added mass member is displaced toward the first and second displacement plates.

19. The vibrator device according to claim 1, wherein a main surface of the added mass member proximal to the first and second displacement plates includes:

a first tilting portion that tilts toward the first displacement plate from a central portion of the added mass member toward the first free end in a first area of the added mass member which opposes the first displacement plate; and a second tilting portion that tilts toward the second displacement plate from the central portion of the added mass member toward the second free end in a second area of the added mass member which opposes the second displacement plate.

20. The vibrator device according to claim 1, further comprising:

a first casing member; and a second casing members, wherein the support member is disposed between the first and second casing members such that the first and second displacement plates and the added mass member are within a case defined by the first and second casing members and the support member.

* * * * *